US007978018B2

(12) United States Patent
Furuta et al.

(10) Patent No.: US 7,978,018 B2
(45) Date of Patent: Jul. 12, 2011

(54) NON-RECIPROCAL CIRCUIT DEVICE

(75) Inventors: Takayuki Furuta, Yokosuka (JP); Hiroshi Okazaki, Zushi (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 87 days.

(21) Appl. No.: 12/372,164

(22) Filed: Feb. 17, 2009

(65) Prior Publication Data

US 2009/0206942 A1 Aug. 20, 2009

(30) Foreign Application Priority Data

Feb. 20, 2008 (JP) ..... 2008-039118
Dec. 15, 2008 (JP) ..... 2008-318725

(51) Int. Cl.
*H01P 1/38* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS

| | | | | |
|---|---|---|---|---|
| 3,605,040 | A | | 9/1971 | Knerr et al. |
| 3,836,874 | A | | 9/1974 | Maeda et al. |
| 5,977,845 | A | * | 11/1999 | Kitahara ..... 333/184 |
| 6,020,793 | A | | 2/2000 | Makino et al. |

FOREIGN PATENT DOCUMENTS

| | | |
|---|---|---|
| DE | 2 251 701 | 5/1974 |
| EP | 0 959 520 A1 | 11/1999 |
| EP | 1 041 664 A1 | 10/2000 |
| JP | 9-93003 | 4/1997 |
| JP | 11-234003 | 8/1999 |
| JP | 2001-119210 | 4/2001 |

OTHER PUBLICATIONS

Ernst Schloemann, "Lumped-element circulator optimization", IEEE MTT-S Digest, XP010069980, May 25, 1988, pp. 757-759.
Hideto Horiguchi et al, "Out-band Attenuation Enhancement and Bandwidth Enlargement in a Small Isolator", Hitachi metals technical review, vol. 17, 2001, pp. 57-62.
Hidehiko Katoh, "Temperature-Stabilized 1.7-GHz Broad-Band Lumped-Element Circulator", IEEE Transactions on Microwave Theory and Techniques, vol. MTT-23, No. 8, Aug. 1975, pp. 689-696.

* cited by examiner

*Primary Examiner* — Stephen E Jones
(74) *Attorney, Agent, or Firm* — Oblon, Spivak, McClelland, Maier & Neustadt, L.L.P.

(57) ABSTRACT

A non-reciprocal circuit device comprising a magnetic plate F1; center conductors L1, L2, and L3 that are mutually insulated and disposed so as to intersect on magnetic plate F1; a plane conductor P1 that is disposed facing the center conductors with magnetic plate F1 placed therebetween, the plane conductor being connected to first ends of all the center conductors; matching capacitors C1 to C3 that have first ends grounded electrically and second ends connected to second ends of the center conductors; first matching circuits that have first ends connected to the second ends of the center conductors and second ends that are input/output ports; and a second matching circuit that has a first end connected to or integrated with the plane conductor and a second end grounded electrically.

6 Claims, 15 Drawing Sheets

NON-RECIPROCAL CIRCUIT DEVICE

TECHNICAL FIELD

The present invention relates to a circuit element including a magnetic plate, more particularly to a non-reciprocal circuit device.

BACKGROUND ART

A lumped constant non-reciprocal circuit device has long been used as an isolator or circulator in a mobile communication device or mobile communication terminal because it requires less space. An isolator is placed between the power amplifier and antenna in the transmitter of a mobile communication device in order to, for example, prevent unwanted signals from reversely entering the power amplifier from the antenna for a desired frequency band or to stabilize impedance on the load side of the power amplifier; a circulator is used in a transmission/reception branch circuit etc.

FIG. 15 is a transparent perspective view illustrating the internal structure of a conventional lumped constant circulator (referred to below simply as circulator 100). FIG. 16 is a circuit diagram illustrating the equivalent circuit of the circulator in FIG. 15. In the equivalent circuit in FIG. 16, a ferrite plate F1 is not shown.

As shown in FIG. 15, in conventional circulator 100, three center conductors L1, L2, and L3 (each of which has two linear conductors having both ends grounded) mutually insulated and superimposed one another so as to intersect at an angle of 120 degrees are placed between a ferrite plate F1 and a ferrite plate F2 (not shown) of the same shape as ferrite plate F1, and permanent magnets (not shown) for magnetizing ferrite plates F1 and F2 are disposed facing each other so as to sandwich ferrite plate F1 and F2 therebetween.

One end of each of center conductors L1, L2, and L3 projects externally from the rims of ferrite plates F1 and F2 and the projection is connected to a signal input/output port (not shown) and one end of each of matching dielectric board pieces (matching capacitors) C1, C2, and C3. The other end of each of center conductors L1, L2, and L3 and the other end of each of matching dielectric board pieces (matching capacitors) C1, C2, and C3 are grounded electrically. Center conductors L1, L2, and L3 have inductance. When a lumped constant circuit element is used as an isolator, the input/output port of center conductor L3 is connected to one end of a terminator and the other end is grounded electrically to absorb reflected signals.

In a structure as described above, if the matching conditions by matching capacitors, the inductances of the center conductors, and the materials of ferrite plates F1 and F2 are optimized, circulator 100 shows irreversibility in a certain frequency range. That is, circulator 100 has high attenuation characteristics (isolation) for a signal that is input to the input/output port connected to one end of the center conductor L1 and output from the input/output port connected to one end of the center conductor L2, a signal that is input to the input/output port connected to one end of the center conductor L2 and output from the input/output port connected to one end of the center conductor L3, and a signal that is input to the input/output port connected to one end of the center conductor L3 and output from the input/output port connected to one end of center conductor L1; circulator 100 has low attenuation characteristics (or opposite characteristics) for signals that are transmitted in the directions opposite to those. If a terminator R1 is connected to the input/output port of the center conductor L3, the non-reciprocal circuit device functions as an isolator, in the corresponding frequency band, which has high attenuation characteristics for a signal that is input to the input/output port connected to one end of the center conductor L1 and output from the input/output port connected to one end of center conductor L2 and has low attenuation characteristics (or opposite characteristics) for signals that are transmitted in the direction opposite to that.

However, the frequency (operating frequency) bandwidth in which a non-reciprocal circuit device such as a conventional isolator or circulator shows irreversibility is generally narrow. (For example, the frequency bandwidth that gives attenuation with an irreversibility of 20 dB at a center frequency of 2 GHz is several tens of hertz.).

Non-patent literature 1 discloses technology for widening the bandwidth of the operating frequency of an isolator. This known technology achieves a bandwidth ratio of 7.7% at a center frequency of 924 MHz by adding an inductor or capacitor to the input end of an isolator. Non-patent literature 2 discloses an example of increasing the fractional bandwidth to 30 to 60% by adding an inductor or capacitor between a center conductor and the ground. Patent literature 1 discloses technology for widening the bandwidth without increasing insertion loss by providing a capacitor between a ground conductor connected to one end of each of three center conductors and the ground. In the above methods of widening the bandwidth, however, there are limits to the extent to which the bandwidth of operating frequency can be widened due to insertion loss or degradation in isolation characteristics, so it is difficult to use these methods for application in which two frequency bands significantly apart (for example, more than one octave band apart) must be covered.

Patent literature 2 discloses a non-reciprocal circuit device that changes the operating frequency with an RF switch for disconnecting or connecting a capacitor disposed on the input/output port of each center conductor to change the resonance frequency of a resonant circuit. In this structure, however, the operating frequency is toggled with the switch, so concurrent use in a plurality of frequency bands is impossible, thereby disabling its usage in an environment in which a plurality of applications for different frequency bands are implemented concurrently. Patent literature 3 discloses a non-reciprocal circuit device that changes operating frequency bands by changing the reactance of a variable capacitor disposed on mutual connection ends of the three center conductors. Since reactance needs to be changed in this structure, however, it is not applicable to an environment in which a plurality of applications for different frequency bands are implemented concurrently as in the structure in patent literature 2.

Patent literature 4 discloses a structure in which two isolators are placed in series with two ferrite plates for dual-band support using an installation area of the size equivalent to that for a single band isolator. However, application to portable terminals is difficult because the height is increased in this structure.

Non-patent literature 1: Hideto Horiguchi, Youichi Takahashi, Shigeru Takeda, "Out-band Attenuation Enhancement and Bandwidth Enlargement in a Small Isolator", Hitachi metals technical review, vol. 17, pp. 57-62, 2001.

Non-patent literature 2: H. Katoh, "Temperature-Stabilized 1.7-GHz Broad-Band Lumped-Element Circulator", IEEE Trans. MTTS Vol. MTT-23, No. 8 August 1975.

Patent literature 1: Japanese Patent Application Laid-Open No. 11-234003

Patent literature 2: Japanese Patent Application Laid-Open No. 9-93003

Patent literature 3: U.S. Pat. No. 3,605,040

Patent literature 4: Japanese Patent Application Laid-Open No. 2001-119210

DISCLOSURE OF THE INVENTION

Problem to be Solved by the Invention

The present invention addresses the above problems with the object of providing a dual-band-capable non-reciprocal circuit device that can solely obtain irreversibility concurrently in two frequency bands significantly apart even though the circuit element has a size equivalent to that of a single-band-capable lumped constant non-reciprocal circuit device in order to achieve multiband/multimode terminals.

Means to Solve the Problems

A non-reciprocal circuit device of the present invention comprises a magnetic plate; a plurality of center conductors, each of which has a first end and a second end, the plurality of center conductors being mutually insulated and disposed so as to intersect on the magnetic plate; a plane conductor disposed facing the plurality of center conductors with the magnetic plate placed between the plane conductor and the plurality of center conductors, the plane conductor being connected to the first ends of all of the plurality of center conductors; a plurality of matching capacitors, each of which has a first end and a second end, the first end being grounded electrically, the second end being connected to the second end of corresponding one of the plurality of center conductors; a plurality of first matching circuits, each of which has a first and a second end, the first end being connected to the second end of corresponding one of the plurality of center conductors, the second end being an input/output port; and a second matching circuit having a first end and a second end, the first end being connected to or integrated with the plane conductor, the second end being grounded electrically.

Effects of the Invention

The non-reciprocal circuit device of the present invention can solely obtain irreversibility concurrently in two frequency bands significantly apart even though the circuit element has a size equivalent to that of a single-band-capable lumped constant non-reciprocal circuit device.

BEST MODES FOR CARRYING OUT THE INVENTION

Preferred embodiments of the present invention will be described below with reference to the drawings. In the embodiments, the present invention is applied to a lumped constant circulator, which is an exemplary non-reciprocal circuit device, but the invention is not limited to the following embodiments.

First Embodiment

A first embodiment of the present invention will be described below.

<Outer Structure>

Figure 1:
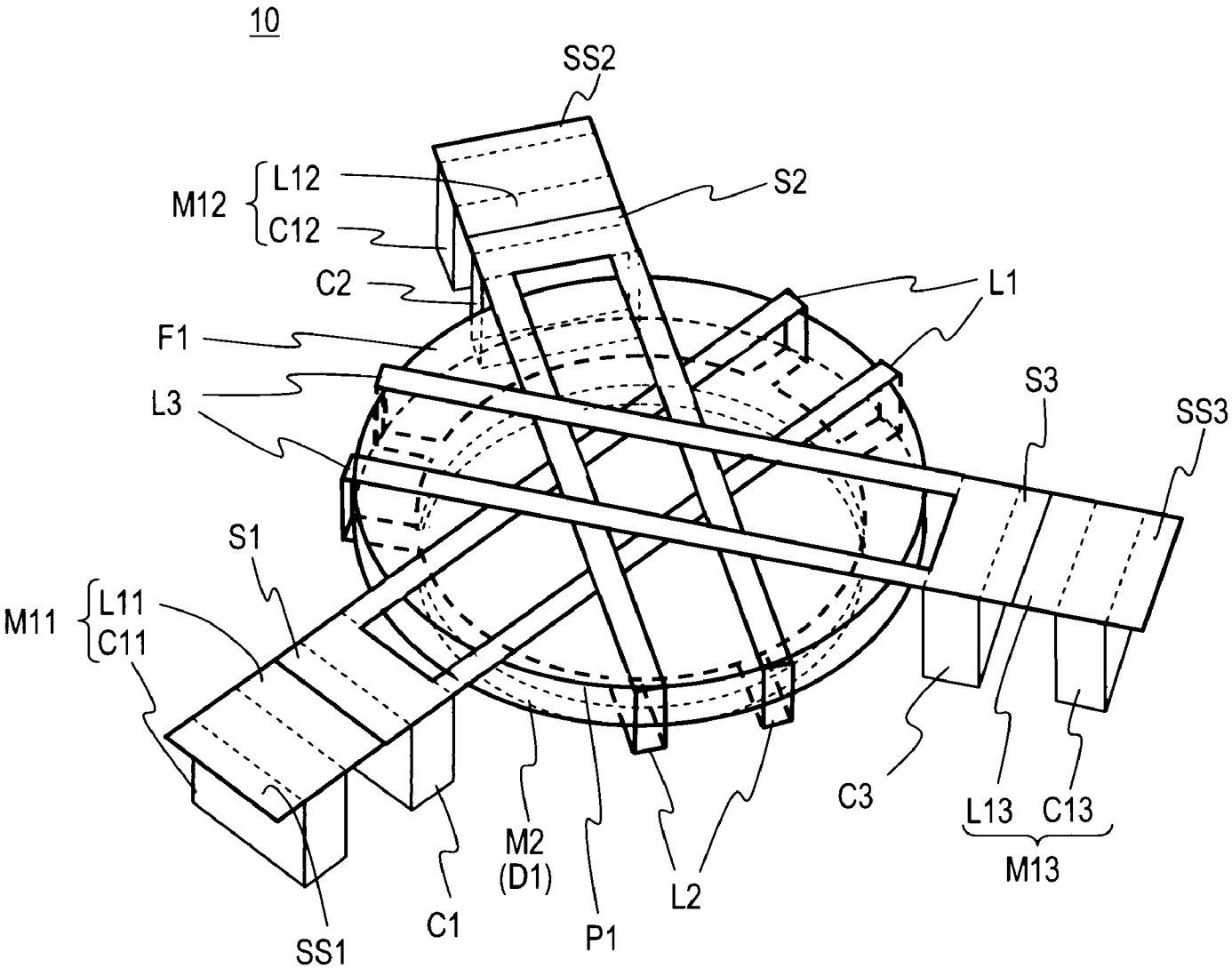
FIG. 1 is a transparent perspective view illustrating an example of the structure of a non-reciprocal circuit device in a first embodiment of the present invention.
Figure 2:
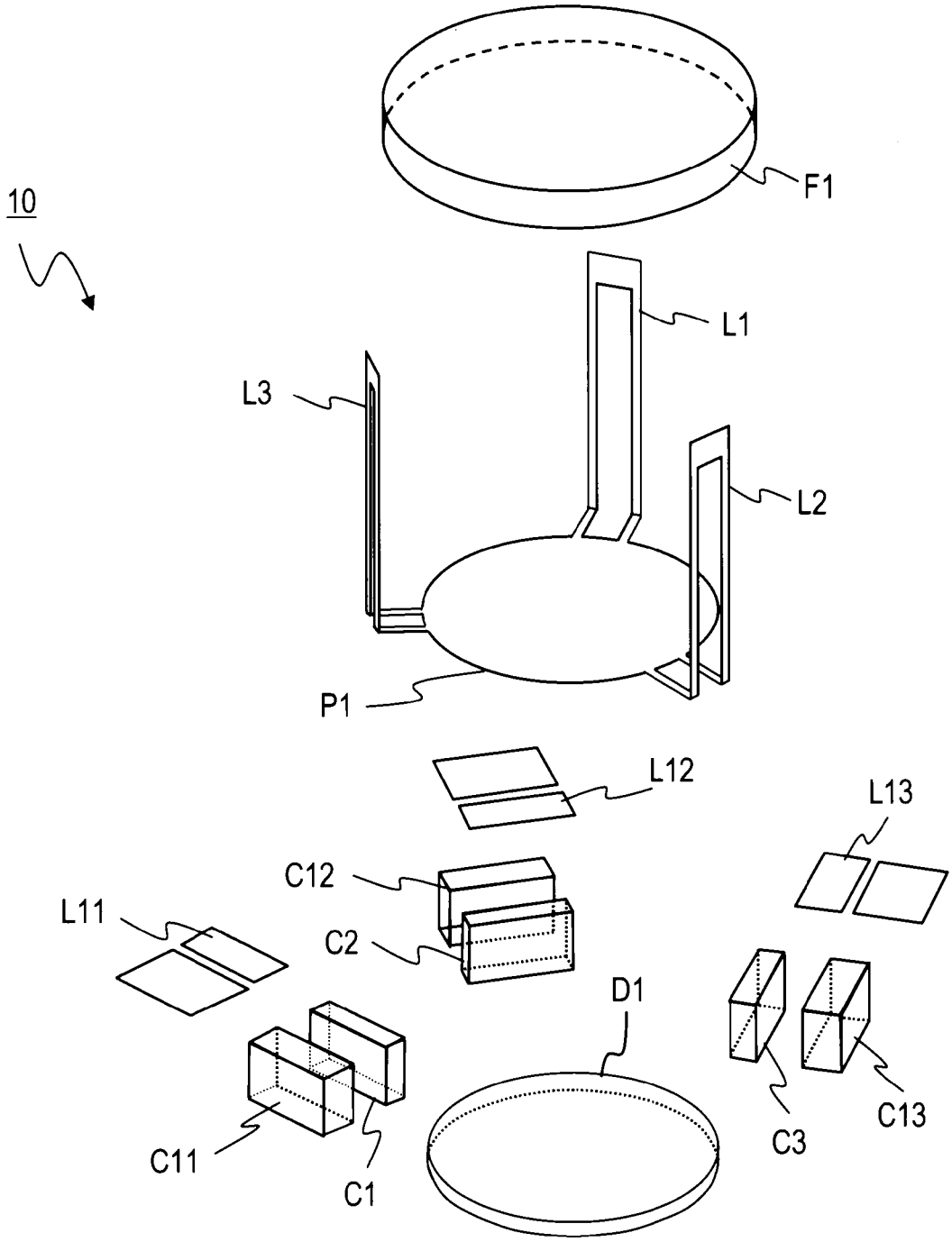
FIG. 2 is an exploded perspective view of the non-reciprocal circuit device in FIG. 1.

FIG. 1 is a transparent perspective view illustrating an example of the structure of a non-reciprocal circuit device 10 in a first embodiment. FIG. 2 is an exploded perspective view of the non-reciprocal circuit device 10 in FIG. 1.

As shown in FIG. 1, non-reciprocal circuit device 10 includes center conductors L1, L2, and L3, matching dielectric board pieces C1, C2, and C3, a ferrite plate (i.e., magnetic plate) F1, a plane conductor P1, first matching circuits M11, M12, and M13, and a second matching circuit M2 (dielectric plate D1 in FIG. 1). The first matching circuit M11 includes a pair of inductor L11 and capacitor C11, the first matching circuit M12 includes a pair of inductor L12 and capacitor C12, and the first matching circuit M13 includes a pair of inductor L13 and capacitor C13.

The plane conductor P1 is a disc-shaped conductor integrated with the center conductors L1, L2, and L3; the first ends of the center conductors L1, L2, and L3 are connected to the three points dividing the rim of the plane conductor P1 into three equal parts. The first ends of the center conductors L1, L2, and L3 are mutually short-circuited and each of the second ends has two parallel lines connected to the rim of the plane conductor P1. The disc-shaped ferrite plate F1 is placed on one surface (top surface in FIG. 1) of the plane conductor P1. The three center conductors L1, L2, and L3 are superimposed on the top surface of the ferrite plate F1 (top surface in FIG. 1) so as to mutually intersect at an angle of 120 degrees. The center conductors L1, L2, and L3 are mutually insulated at the intersections. It is not necessary to make the center conductors intersect at the same angle and to place the center conductors so that their barycenters match as in this example. Preferably, the center conductors intersect at the same angle and their barycenters match in order to obtain sufficient irreversibility or make adjustment of frequency easier.

Figure 3A:
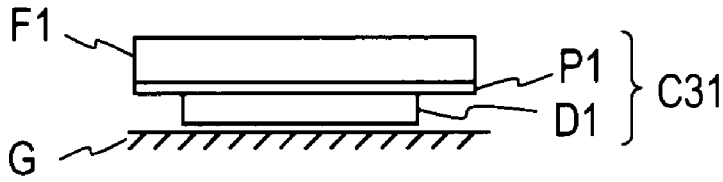
FIG. 3A shows an embodiment of a capacitor C31, which is part of the non-reciprocal circuit device.
Figure 3B:
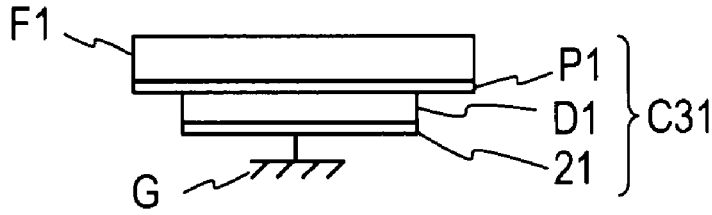
FIG. 3B shows another embodiment of a capacitor C31, which is part of the non-reciprocal circuit device.
Figure 3C:
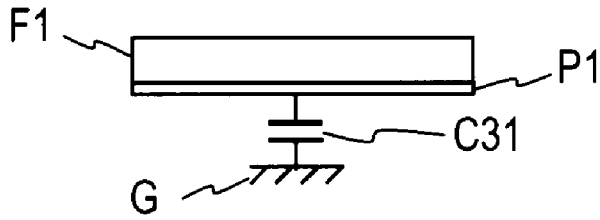
FIG. 3C shows yet another embodiment of a capacitor C31, which is part of the non-reciprocal circuit device.

The surface (bottom surface in FIG. 1) of the plane conductor P1, on which the ferrite plate F1 is not placed, is connected to the second matching circuit M2. A ground conductor on a unit board (not shown), on which a non-reciprocal circuit device is to be mounted, is indicated below by reference character G, as shown in FIG. 3A, which illustrates part of the non-reciprocal circuit device. In the structure in FIG. 1, a capacitor C31 with a desired capacity is formed by loading dielectric plate D1 between the plane conductor P1 and the ground conductor G as shown in FIG. 3A and the capacitor C31 functions as the second matching circuit M2. This capacitor C31 can be a parallel plate capacitor formed between a conductive layer 21 formed on the ground side of the dielectric plate D1 opposite from the plane conductor P1, and the plane conductor P1, as shown in FIG. 3B. This capacitor C31 can also be a chip capacitor connected between the plane conductor P1 and the ground conductor G instead of using a dielectric plate D1, as shown in FIG. 3C. In the case of connecting a chip capacitor, however, if symmetry of connection with respect to the plane conductor P1 is lost, the impedance seen at each input/output port would become different. Accordingly, it is desirable to load a capacitor (dielectric plate D1 in FIG. 2) so that the center of the bottom surface of the plane conductor P1 matches the connection point (or the center of the plane in the case of surface contact) of the capacitor.

Projection ends S1, S2, and S3 (opposite to the ends connected to the plane conductor P1) of the center conductors L1, L2, and L3 project externally from the rim of the ferrite plate F1. The projection ends S1, S2, and S3 are connected to the first ends of the inductors L11, L12, and L13, respectively. Matching dielectric board pieces C1, C2, and C3 are further attached on the surfaces of the projection ends S1, S2, and S3, which face the ground conductor, to form matching capacitors between each of the projection ends S1, S2, and S3 and the ground conductor G. Reference characters C1, C2, and C3 for matching dielectric board pieces are also used below as the reference characters of these matching capacitors. The second ends of the inductors L11, L12, and L13 configure input/output ports SS1, SS2, and SS3, respectively, and are connected to the first ends of the capacitors C11, C12, and C13, respectively. The second ends of the capacitors C11, C12, and C13 are grounded electrically. Pairs of an inductor and a capacitor, (L11, C11), (L12, C12), and (L13, C13), constitute the first matching circuits M11, M12, and M13, respectively.

A chip inductor, a line with a certain length, etc. can be used to implement each of the inductors L11 to L13. A chip capacitor, a varactor such as a PIN diode, etc. can be used or a dielectric having one end grounded can be sandwiched to implement each of the capacitors C11 to C13. A permanent magnet for magnetizing the ferrite plate F1 is actually disposed facing the ferrite plate F1, but the permanent magnet is not shown in the figure.

<Circuit Configuration>

Figure 4:
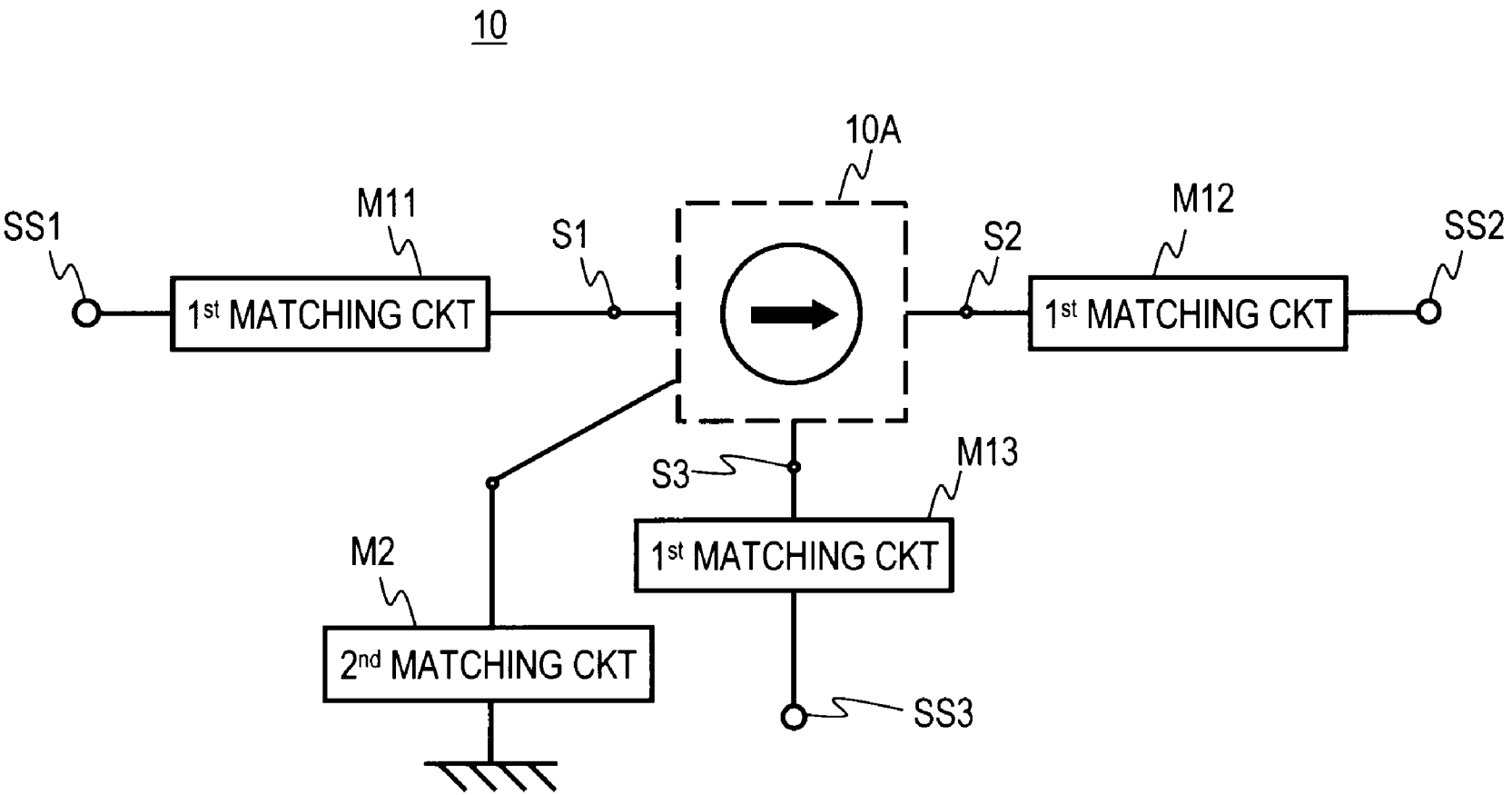
FIG. 4 is a block diagram illustrating the structure of the inventive non-reciprocal circuit device.
Figure 5:
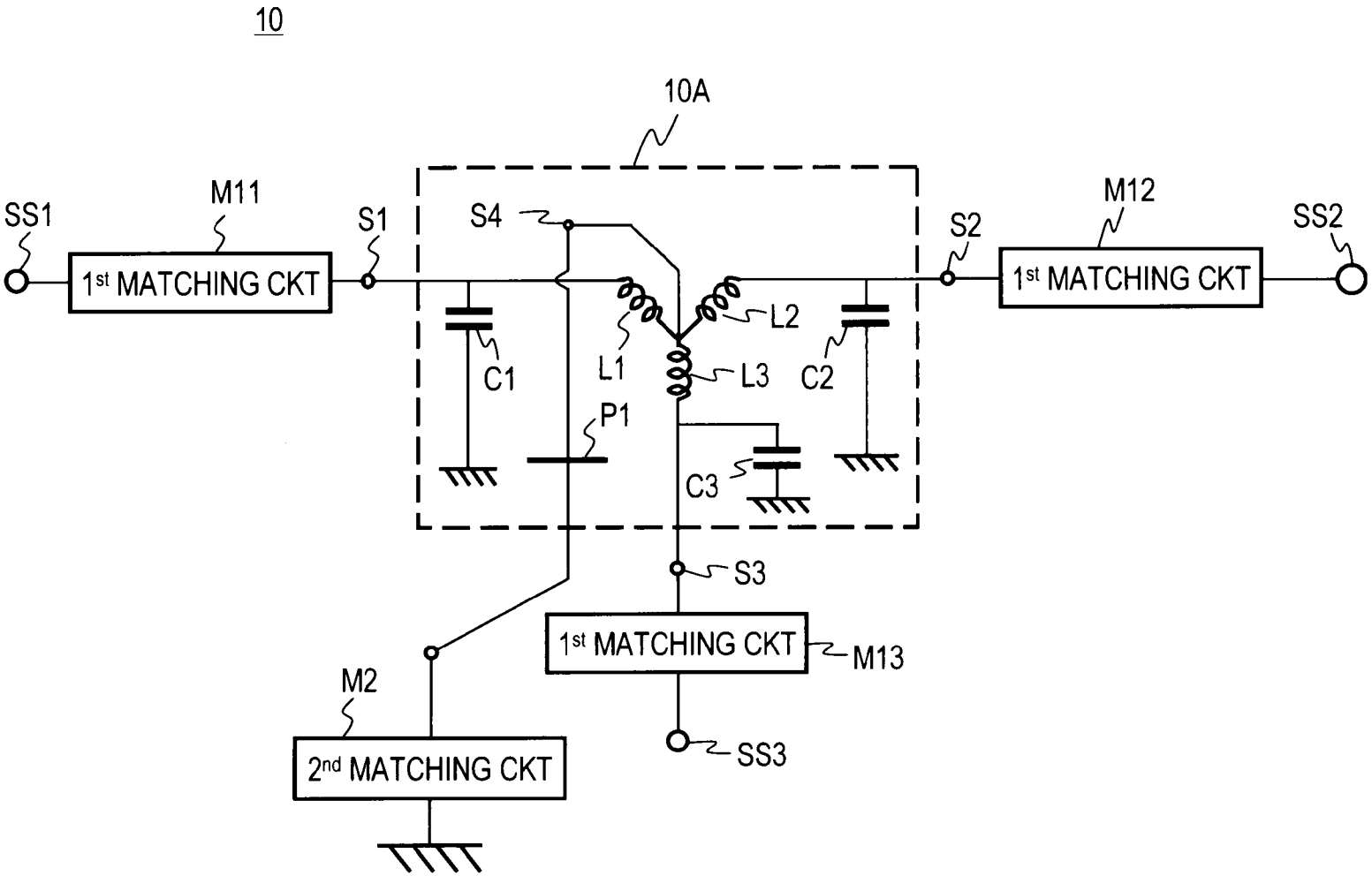
FIG. 5 is the block diagram in FIG. 4 to which an equivalent circuit of a circulator unit is added.

FIG. 4 is a block diagram of the structure of the present invention. FIG. 5 shows a configuration obtainable by adding an example of the equivalent circuit of a circulator unit 10A to FIG. 4 (ferrite plate F1 is not shown). An equivalent circuit of the conventional circulator corresponds to the equivalent circuit of the circulator unit 10A in FIG. 5 in which P1 is grounded. The circuit configuration of non-reciprocal circuit device 10 will be described below with reference to FIG. 5.

Figure 7A:
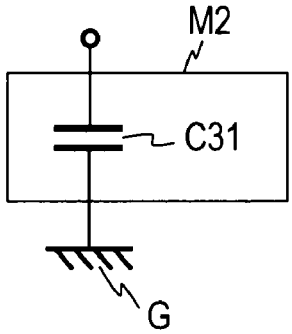
FIG. 7A shows an example of the structure of a second matching circuit.

As shown in FIG. 5, the ends of the three center conductors L1, L2, and L3, that are opposite to the projection ends S1, S2, and S3 are mutually connected and the connection ends S4 are connected to the plane conductor P1. In an actual structure in FIG. 1, the first ends of the center conductor L1, L2, and L3 are connected mutually because they are connected to the plane conductor P1. A first end of the second matching circuit M2 is connected to the plane conductor P1 and a second end is grounded electrically. The second matching circuit M2 is configured as, for example, a capacitor C31 as shown in FIG. 7A, more specifically can be achieved by loading a dielectric plate D1 between the plane conductor P1 and the ground conductor G as shown in FIGS. 3A and 3B or by inserting chip capacitor C31 between the plane conductor P1 and the ground conductor G as shown in FIG. 3C. The first ends of the matching dielectric board pieces C1, C2, and C3 are connected to the projection ends S1, S2, and S3 of the center conductors L1, L2, and L3, respectively, and the second ends are grounded electrically to form matching capacitors (reference characters C1, C2, and C3 are also used, respectively).

Figure 6A:
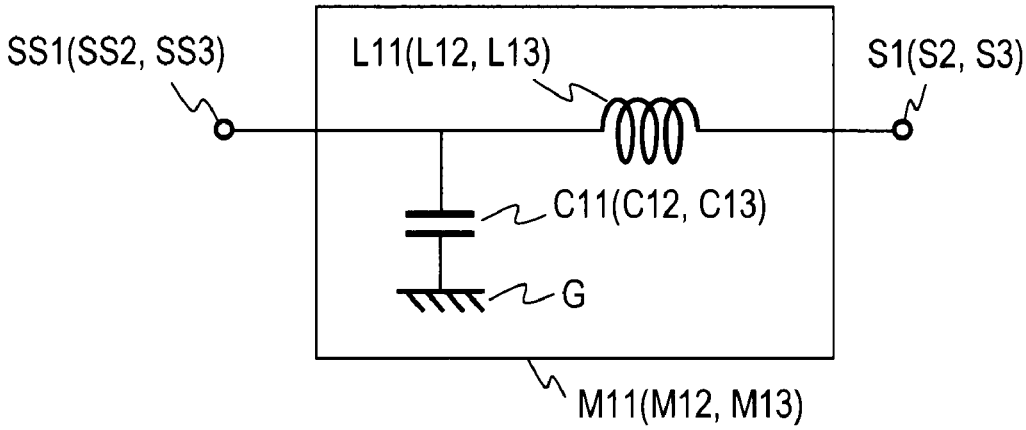
FIG. 6A shows an example of the structure of a first matching circuit.

In addition, the first ends of the first matching circuits M11, M12, and M13 are connected to the projection ends S1, S2, and S3 of the center conductors L1, L2, and L3, respectively; the second ends of the first matching circuits M11, M12, and M13 constitute input/output ports SS1, SS2, and SS3, respectively. The first matching circuit M11 has a pair of, for example, inductor L11 and capacitor C11 as shown in FIG. 6A. More specifically, the inductor L11 is connected between the center conductor L1 and the input/output port SS1 and one end of the capacitor C11 is connected to either end of the inductor L11 and the other end is grounded. The first matching circuits M12 and M13 also comprise a pair of inductor L12 and capacitor C12 and a pair of inductor L13 and capacitor C13, respectively.

<Principle of Operation>

The first frequency band (higher frequency side) of the dual-band is determined mainly by the center conductors L1, L2, and L3, the matching capacitors C1, C2, and C3, and the inductances and capacitances of the first matching circuits M11, M12, and M13. The second frequency band (lower frequency side) of the dual-band is determined mainly by the inductances and capacitances of the first matching circuits M11, M12, and M13 and the inductance and capacitance of the second matching circuit M2. If the capacitances of the matching capacitors C1, C2, and C3 are increased, the interval between the two frequency bands (first frequency band and second frequency band) is reduced. If fine tuning is performed by the first matching circuits M11, M12, and M13 and the second matching circuit M2, high isolation can be achieved with low transmission loss. In addition, if the capacitances of the first matching circuits M11, M12, and M13 are increased and the inductances are reduced, the operating frequency bands can be shifted to the lower side; if the capacitances are reduced and the inductances are increased, the operating frequency bands can be shifted to the higher side. The insertion loss and degradation in isolation characteristics depend on the characteristics (such as the size and saturation magnetization) of the ferrite plate F1 or the external magnetic field strength. The lower limit of the second operating frequency band shifted by adjustment of the inductance or capacitance depends on these characteristics. Accordingly, if the size and properties (characteristics) of the ferrite plate F1 are selected appropriately, the second operating frequency band can be shifted to a lower side. A shift to a lower side is achieved by, for example, increasing the diameter of the ferrite plate, selecting a ferrite with a lower saturation magnetization, or reducing the external magnetization strength.

<Characteristic Data>

Transmission characteristics data will be shown below to clarify the effect of the invention. In the following description, reference characters L1, L2, and L3 for the center conductors also indicate their line lengths, reference characters L11, L12, and L13 for the inductors also indicate their inductances, and reference characters C1, C2, and C3 for the capacitors also indicate their capacitances.

Figure 8:
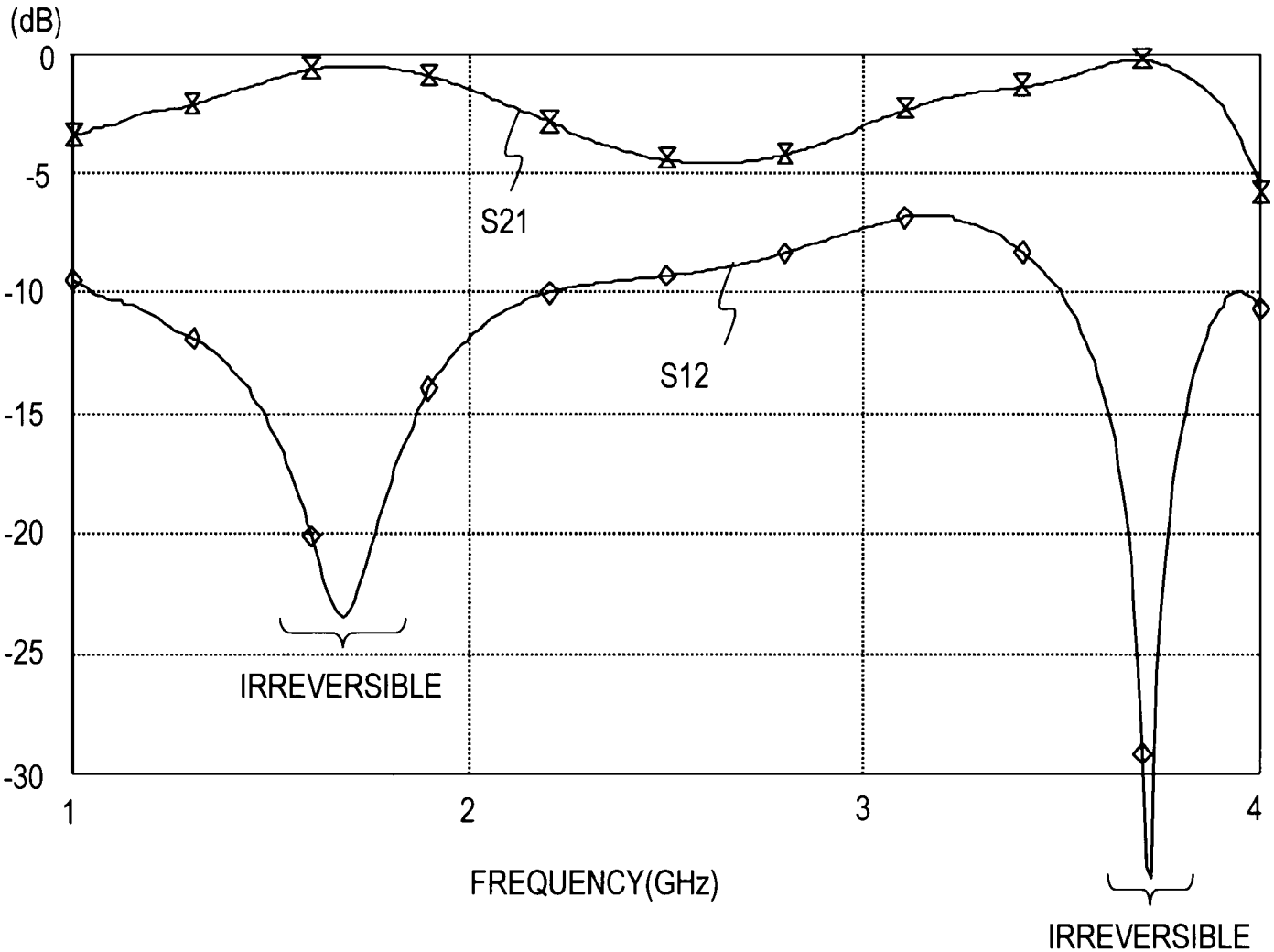
FIG. 8 is a graph illustrating the transmission characteristics of the non-reciprocal circuit device in FIG. 4.

FIG. 8 is a graph showing transmission characteristics S12 and S21 of the circulator indicated by the equivalent circuit in FIG. 5 in the first embodiment. In this circulator, the first matching circuits M11, M12, and M13 have the structure shown in FIG. 6A and the second matching circuit M2 has the structure shown in FIG. 7A. The values of L1 to L3 are 2.9 mm, the values of C1 to C3 are 2.1 to 2.2 pF, the values of L11 to L13 are 1.9 to 2.0 nH, the values of C11 to C13 are 2.3 to 2.5 pF, and the value of C31 is 0.33 pF. As shown in this graph, the frequency bands in which an irreversibility of 20 dB or more can be obtained are the 1.6 GHz and 3.7 GHz bands, and irreversibility can be achieved in both of the frequency bands more than one octave band apart. In addition, 100 MHz or more of bandwidth with an isolation of 20 dB or more can be obtained in both of the frequency bands.

Figure 9:
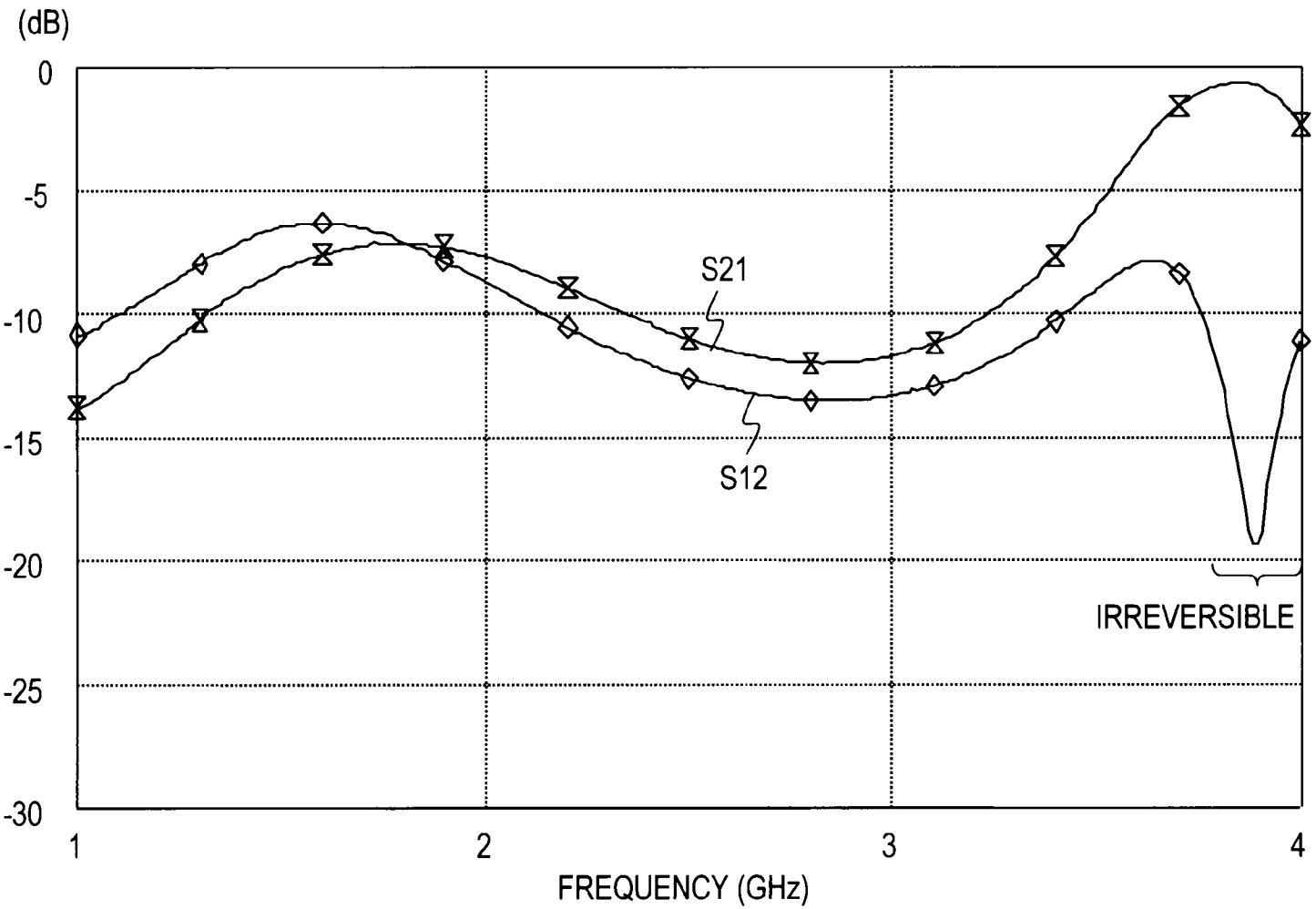
FIG. 9 is a graph illustrating the transmission characteristics of the non-reciprocal circuit device in FIG. 4 from which the second matching circuit is removed.

FIG. 9 is a graph showing transmission characteristics S12 and S21 of the circulator from which the second matching circuit M2 is removed, that is the circulator in which the plane conductor P1 is grounded electrically and only the first matching circuits M11, M12, and M13 are left. As shown in this graph, irreversibility can be obtained in the high frequency band (3.9 GHz band), but irreversibility is lost in the low frequency band. That is, second matching circuit M2 contributes to matching in the low frequency band.

Figure 10:
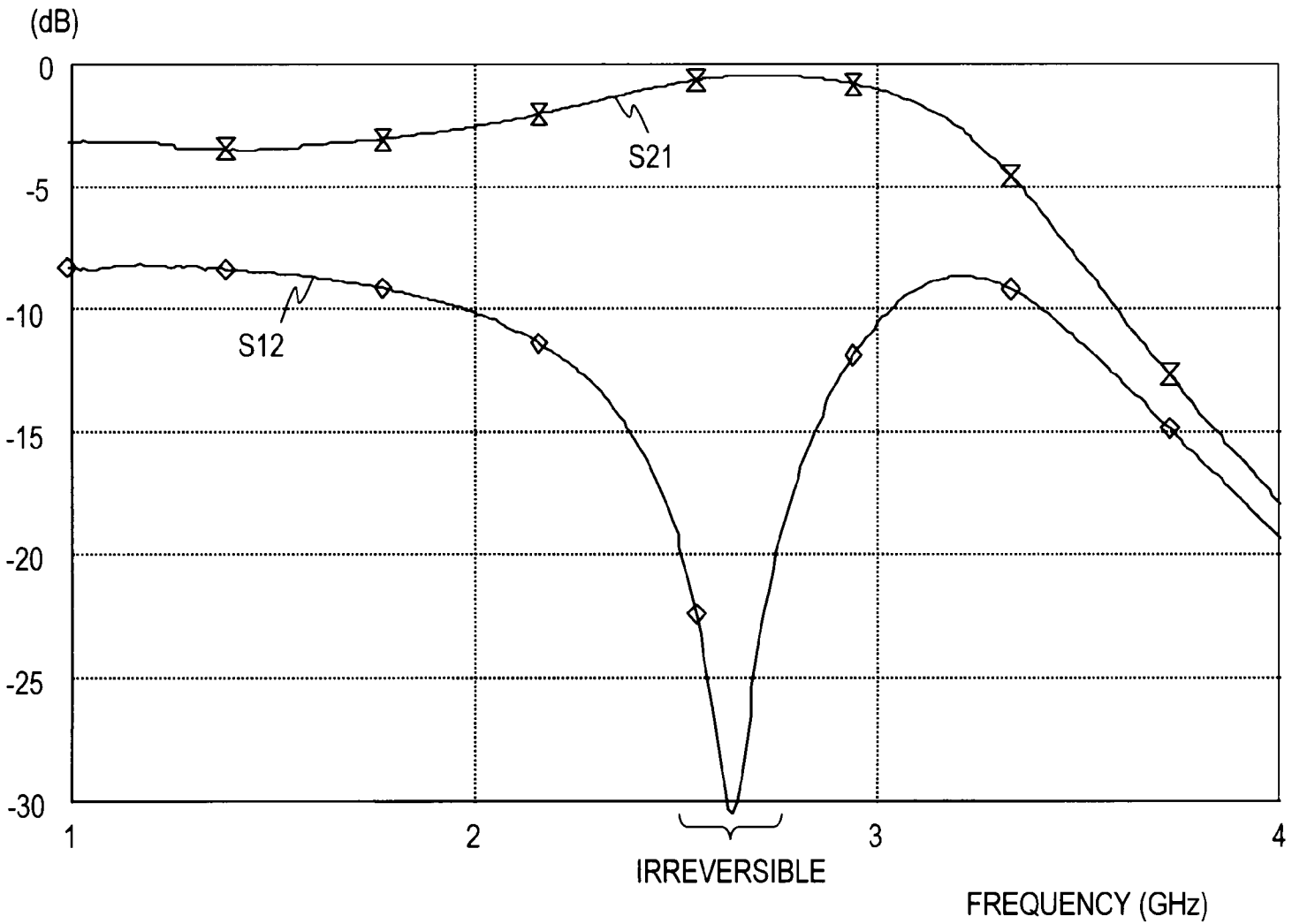
FIG. 10 is a graph illustrating the transmission characteristics of the non-reciprocal circuit device in FIG. 4 from which the first matching circuits are removed.

FIG. 10 is a graph showing transmission characteristics S12 and S21 of the circulator from which the first matching circuits M11, M12, and M13 are removed, that is the circulator in which only the second matching circuit M2 is left. In FIG. 10, irreversibility can be obtained in the high frequency band (2.7 GHz band), but irreversibility is lost in the low frequency band as in FIG. 9. That is, the first matching circuits M11, M12, and M13 also contribute to matching in the low frequency band. However, the frequency band in which irreversibility can be obtained in FIG. 9 is different from that in FIG. 10. This indicates that the effects on the characteristics of the circulator differ between the first matching circuits M11, M12, and M13 and the second matching circuit M2. If the circulator has both the first matching circuits M11, M12, and M13 and the second matching circuit M2, the characteristics of the circulator can be set flexibly by setting their parameters appropriately.

Figure 11:
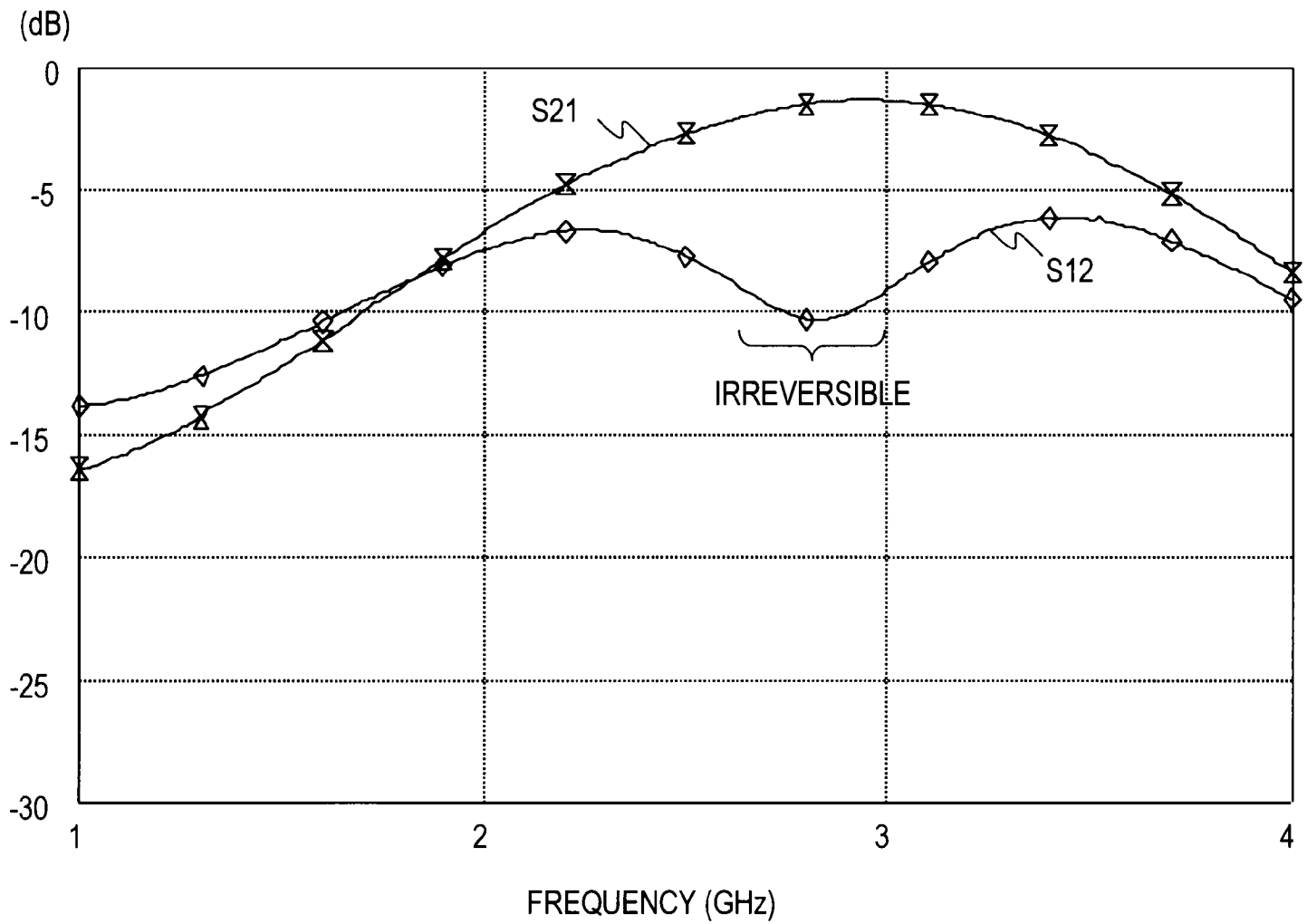
FIG. 11 PRIOR ART
FIG. 11 is a graph illustrating the transmission characteristics of the non-reciprocal circuit device in FIG. 4 from which the first and second matching circuits are removed.

FIG. 11 is a graph showing transmission characteristics S12 and S21 of the circulator from which both first matching circuits M11, M12, and M13 and second matching circuit M2 are removed, that is a conventional lumped constant circulator. There are shifts in frequency bands as compared with FIGS. 9 and 10, but irreversibility is seen in the high frequency band (3 GHz band). That is, the matching dielectric board pieces (matching capacitors) C1 to C3 and the center conductors (inductors) L1 to L3 greatly contribute to matching in the high frequency band. There is degradation in reversibility in the graphs of FIGS. 9 to 11 as compared with the graph of FIG. 8. This is because the parameter values selected to obtain the optimum characteristics in the structure in which both the first matching circuits M11, M12, and M13 and the second matching circuit M2 are connected are used as is in the structure in which these matching circuits are removed.

Figure 12:
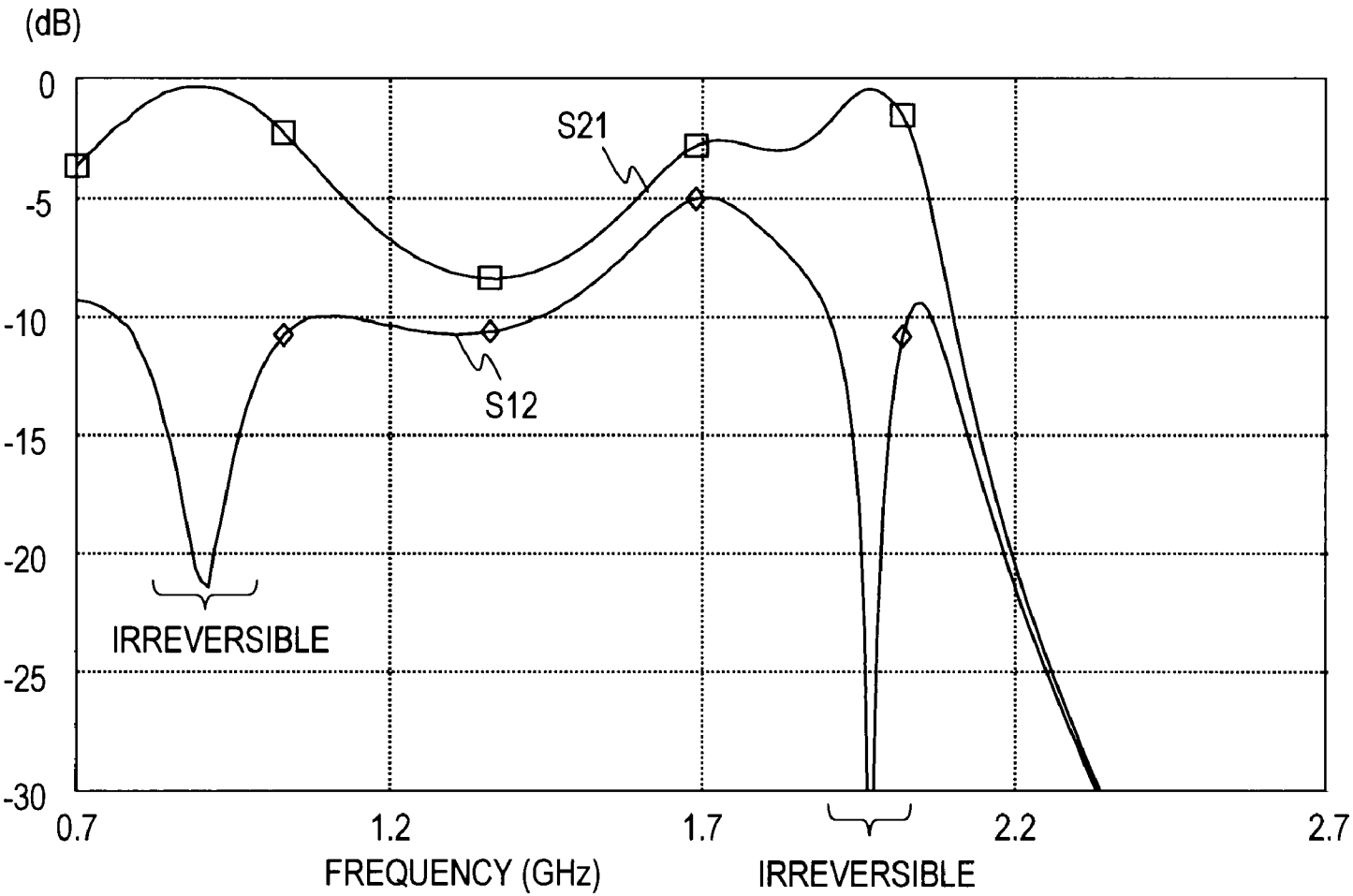
FIG. 12 is a graph illustrating changes in transmission characteristics when the values of inductors and capacitors in the first matching circuits of the non-reciprocal circuit device in FIG. 4 vary.

Next, an example of how the transmission characteristics depend on difference in inductances L11 to L13 and capacitances C11 to C13 in first matching circuits M11, M12, and M13. FIG. 12 is a graph showing transmission characteristics S12 and S21 when the inductances of L11 to L13 are 2 nH and the capacitances of C11 to C13 are 7 pF; the frequency bands in which an irreversibility of 20 dB or more can be obtained are of the 1.6 GHz and 2.7 GHz bands. As shown in FIG. 12, if the capacitances are reduced and inductances are increased, the operating frequency bands can be shifted to the higher side.

A comparison of characteristics data in FIG. 8 with characteristics data in FIG. 12 shows that the interval between the first operating frequency and the second operating frequency is reduced as the capacitances of the matching capacitors C1 to C3 are increased. More specifically, the interval is 2 GHz in characteristics data in FIG. 8 where a capacitance of 2.1 to 2.2 pF is used; the interval is 1.2 GHz in characteristics data in FIG. 12 where a capacitance of 6 to 7 pF is used.

Second Embodiment

Figure 6B:
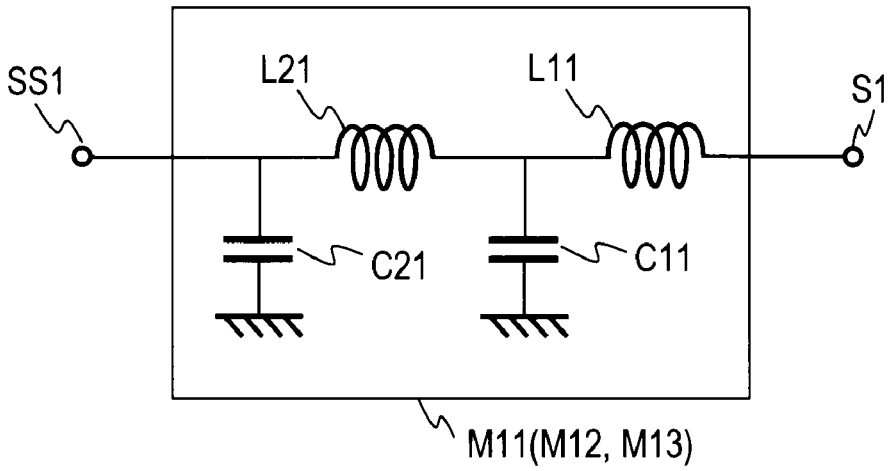
FIG. 6B shows another example of the structure of the first matching circuit.

The first matching circuits with the structure shown in FIG. 6A is illustrated in the first embodiment, but two (or more) stages of the LC circuits in FIG. 6A may also be loaded as shown in FIG. 6B. If a plurality of stages of LC circuits are loaded in this way, the number of points where parameters can be adjusted is increased, thereby making dual-band adjustment easier.

Figure 13:
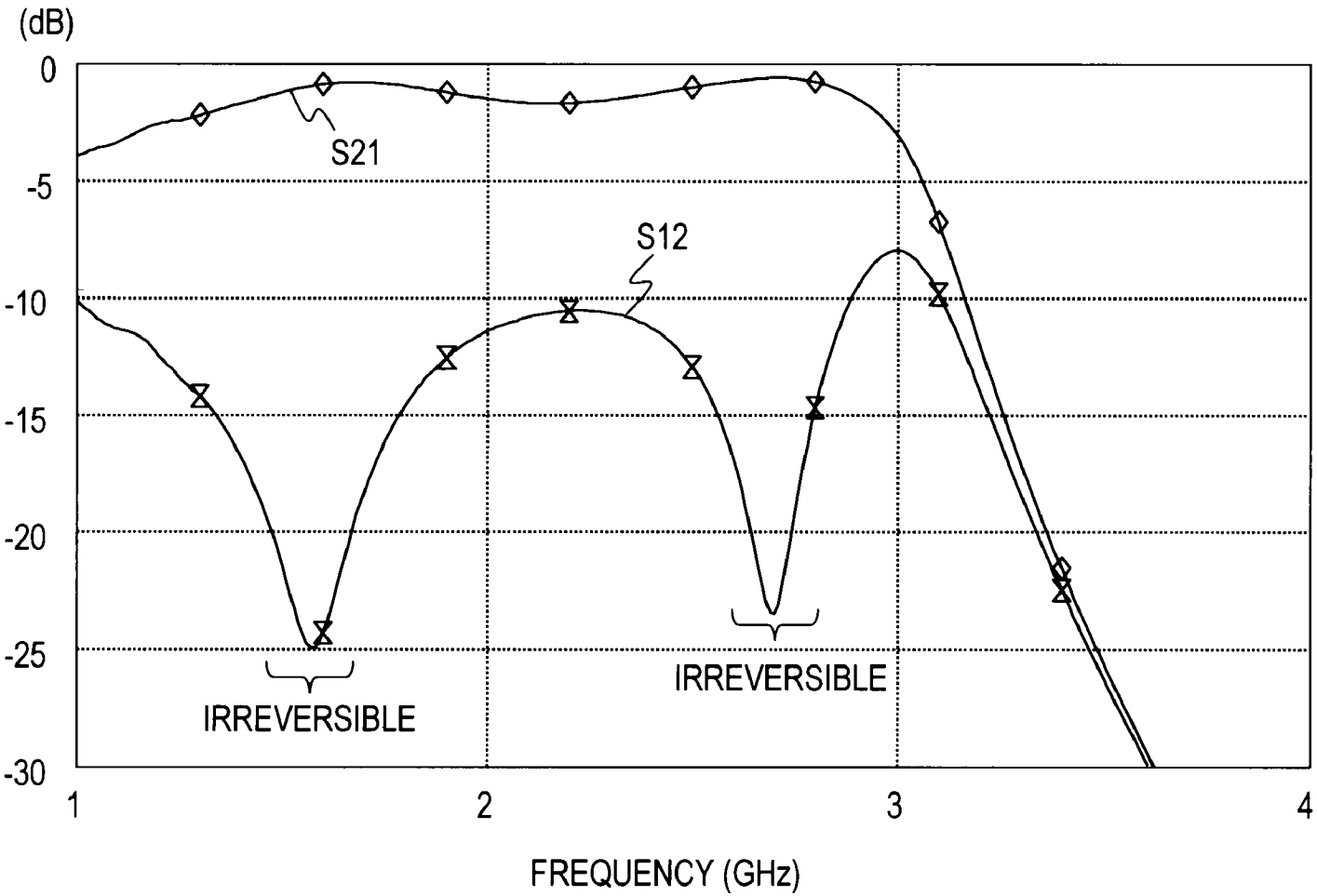
FIG. 13 is another graph illustrating changes in transmission characteristics when the values of inductors and capacitors in the first matching circuits of the non-reciprocal circuit device in FIG. 4 vary.
Figure 14:
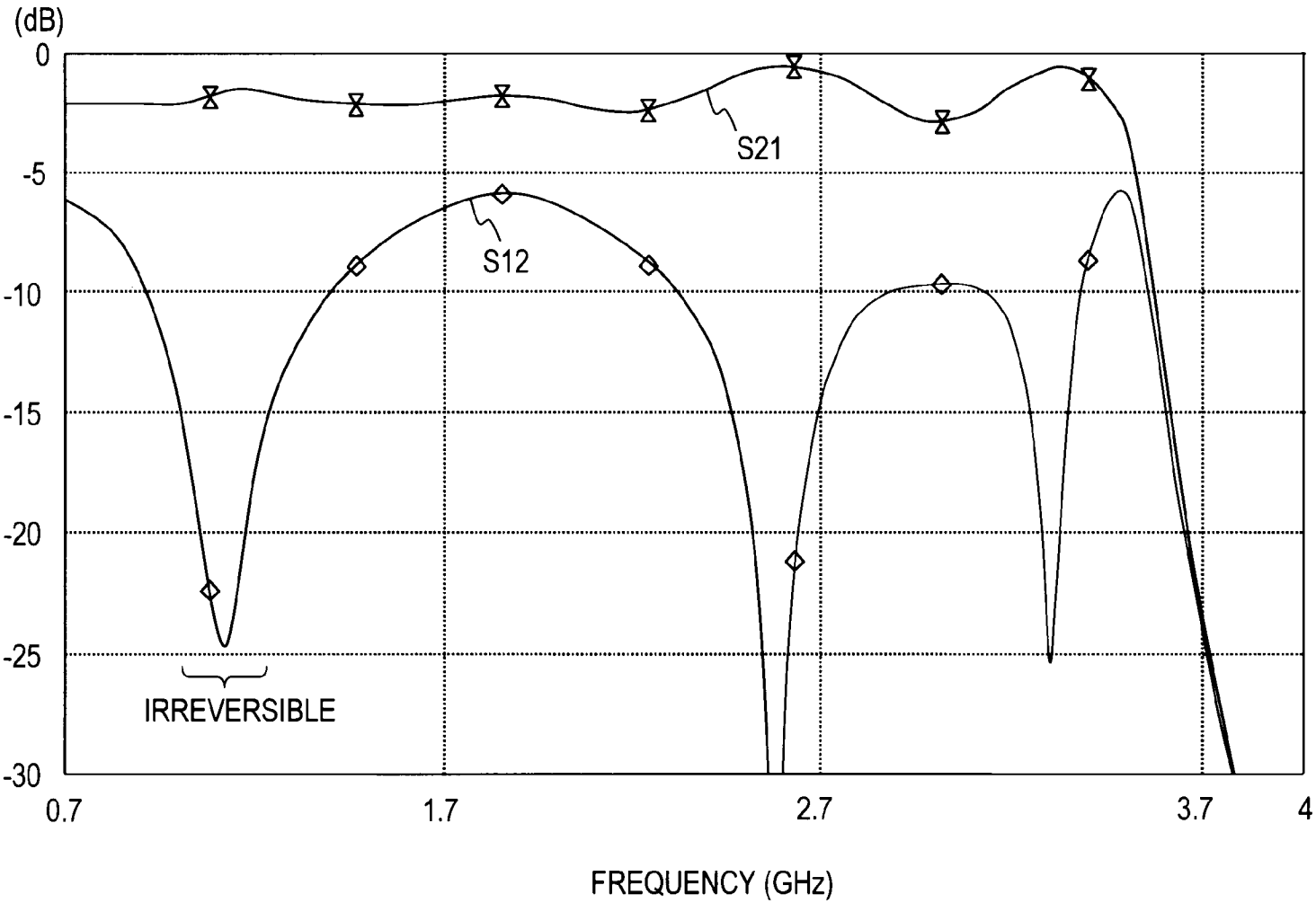
FIG. 14 is another graph illustrating changes in the transmission characteristics when the values of inductors and capacitors in the first matching circuits of the non-reciprocal circuit device in FIG. 4 vary.
Figure 15:
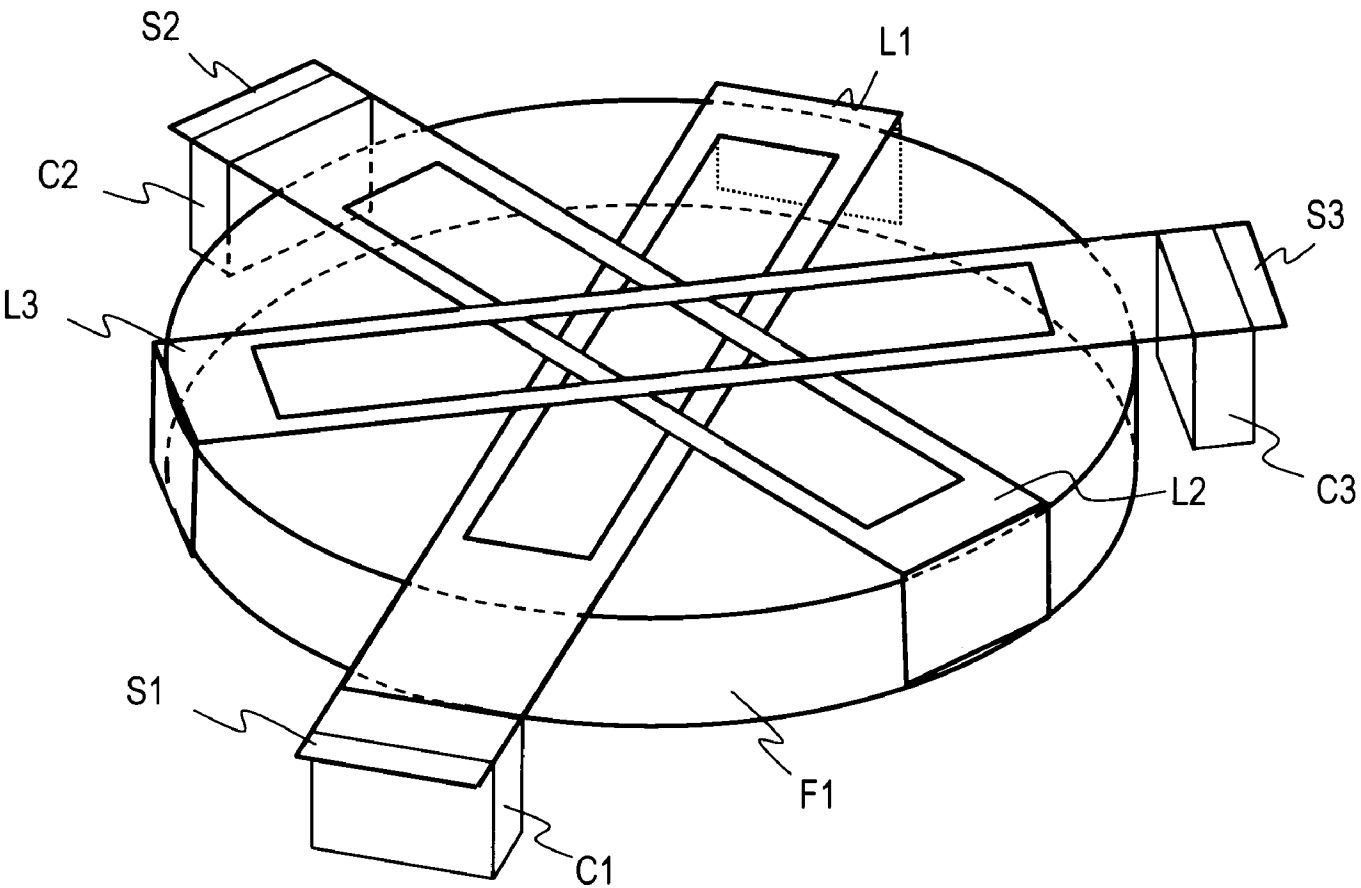
FIG. 15 PRIOR ART
FIG. 15 is a transparent perspective view illustrating the internal structure of a conventional lumped constant isolator.
Figure 16:
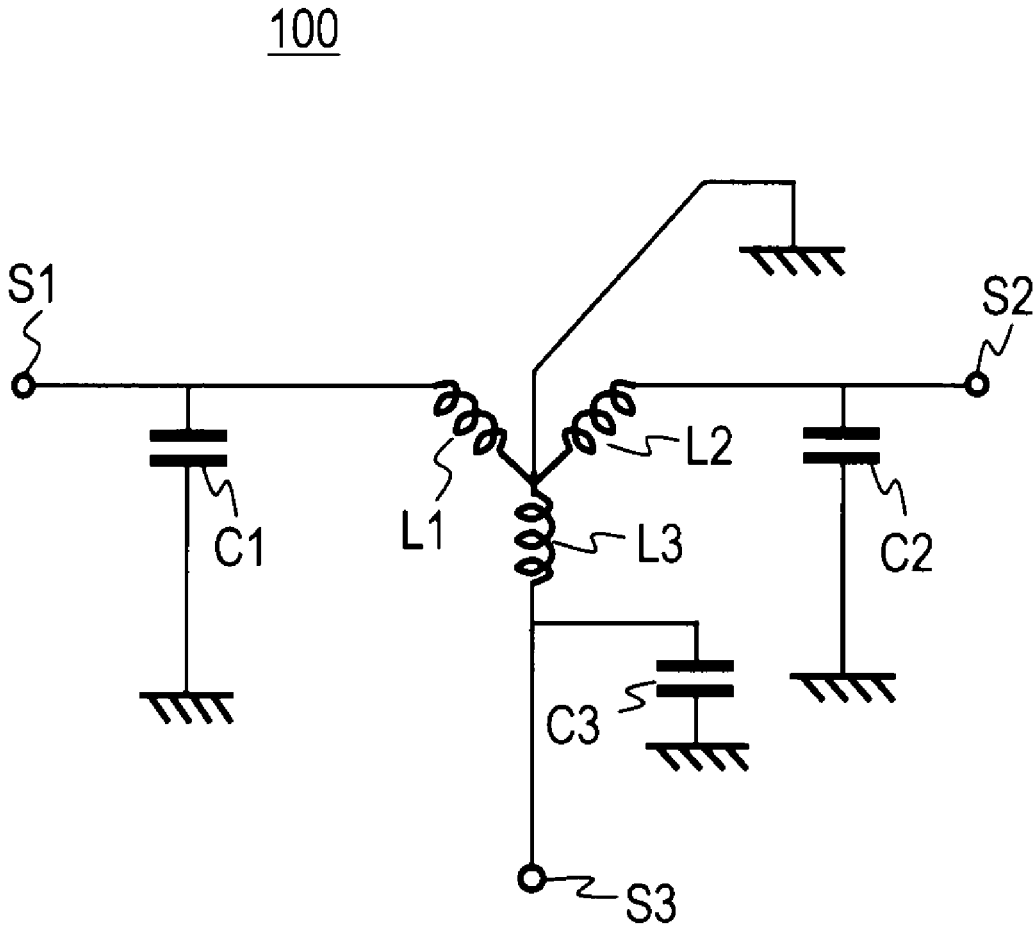
FIG. 16 PRIOR ART
FIG. 16 is the equivalent circuit of the lumped constant isolator in FIG. 15.

In addition, the number of combinations of LC resonant circuits is increased, so the number of bands in which irreversibility can be obtained is increased. FIG. 14 shows exemplary transmission characteristics S12 and S21 when two stages of LC circuits are loaded for each first matching circuit M1, M2 and M3. This data assumes that the circulator indicated by the equivalent circuit in FIG. 5 includes first matching circuits M11, M12, and M13 with the structure shown FIG. 6B and the second matching circuit M2 with the structure having the capacitor C31 in FIG. 7A. As described in the first embodiment, the capacitor 31 may have any of the structures shown in FIGS. 3A, 3B, and 3C. The values of parameters L1 to L3 are 2.9 mm, the values of C1 to C3 are 2.1 to 2.2 pF, the values of L11 to L21 of each port are 3 nH, the values of C11 to C21 of each port are 2 pF, and the value of C31 is 0.33 pF. That is, this structure uses the same parameter values as in FIG. 13 and has another stage of the same LC circuit added. As shown in FIG. 14, the frequency bands in which an irreversibility of 20 dB or more can be obtained are the 1.1 GHz, 2.6 GHz, and 3.3 GHz bands; the number is increased by 1 as compared with the number in the circuit with one stage of LC circuit in FIG. 12.

Third Embodiment

Figure 7B:
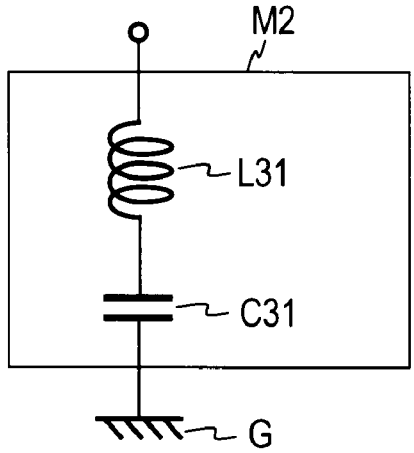
FIG. 7B shows another example of the structure of the second matching circuit.

The structure including the capacitor C31 shown in FIG. 7A is described as the second matching circuit M2 in the first embodiment, but an inductor L31 may also be loaded in series with the capacitor C31 as shown in FIG. 7B. The inductor loaded in this manner can expand the width of each frequency band and make adjustments between frequency bands easy by changing the inductance appropriately. The inductor may be a line with a certain length connected between the conductive layer 21 and the ground conductor G in FIG. 3B or a similar line inserted between plane conductor P1 and capacitor C31 in FIG. 3C.

The present invention is not limited to the above three embodiments. For example, the present invention is applied to a lumped constant circulator, which is an exemplary non-reciprocal circuit device, in the above embodiments, but the invention may be applied to a lumped constant isolator. In this case, a terminator R1 is added to input/output port SS3 described in the first embodiment. It will be appreciated that various modifications may be made as appropriate without departing from the scope of the invention.

INDUSTRIAL APPLICABILITY

The non-reciprocal circuit device of the present invention is particularly applicable to an isolator or circulator in wide-band communication devices such as mobile phone terminals for dual-band use.

What is claimed is:

1. A non-reciprocal circuit device comprising:

a magnetic plate;

a plurality of center conductors, each of which has a first end and a second end, the plurality of center conductors being mutually insulated and disposed so as to intersect on the magnetic plate;

a plane conductor disposed facing the plurality of center conductors with the magnetic plate placed between the plane conductor and the plurality of center conductors, the plane conductor being connected to the first ends of all of the plurality of center conductors;

a plurality of matching capacitors, each of which has a first end and a second end, the first end being directly grounded, the second end being connected directly to the second end of corresponding one of the plurality of center conductors;

a plurality of first matching circuits, each of which has a first end and a second end, the first end being connected directly to the second end of corresponding one of the plurality of center conductors, the second end being an input/output port, each of the plurality of the first matching circuits including at least a first pair of an inductor connected in series between each of the plurality of center conductors and the input/output port and a capacitor having a first end and a second end, the first end being connected to one end of the inductor on the input/output port side, the second end being directly grounded; and a second matching circuit having a first end and a second end, the first end being connected to or integrated with the plane conductor, the second end being grounded electrically.

2. The non-reciprocal circuit device of claim 1, wherein the plurality of center conductors mutually intersect at a same angle and barycenters of the plurality of center conductors match.

3. The non-reciprocal circuit device of claim 1 or 2, wherein each of the plurality of the first matching circuits further includes a second pair of an inductor connected in series with the inductor of the first pair between the corresponding center conductor and the corresponding input/output port and a capacitor having a first end and a second end, the first end being connected to one end of the inductor of the second pair on the input/output port side, the second end being grounded.

4. The non-reciprocal circuit device of claim 1 or 2, wherein the second matching circuit is composed of a capacitor.

5. The non-reciprocal circuit device of claim 1 or 2, wherein the second matching circuit comprises a capacitor and an inductor connected in series.

6. The non-reciprocal circuit device of claim 1 or 2, wherein each of the plurality of the first matching circuits further includes a second pair of an inductor connected in series with the inductor of the first pair between the corresponding center conductor and the corresponding input/output port and a capacitor having a first end and a second end, the first end being connected to one end of the inductor of the second pair on the corresponding input/output port side, the second end being directly grounded.

* * * * *